US007862385B2

(12) United States Patent
Lee

(10) Patent No.: US 7,862,385 B2
(45) Date of Patent: Jan. 4, 2011

(54) EXTENSION CORD LOCK AND IN LINE TAP

(75) Inventor: Dominic Kan Nam Lee, Hong Kong (CN)

(73) Assignee: Multiway Industries (HK) Ltd., Tsuen Wan, Hong Kong (CN)

( * ) Notice: Subject to any disclaimer, the term of this patent is extended or adjusted under 35 U.S.C. 154(b) by 142 days.

(21) Appl. No.: 12/231,508

(22) Filed: Sep. 3, 2008

(65) Prior Publication Data

US 2010/0159733 A1 Jun. 24, 2010

Related U.S. Application Data

(60) Provisional application No. 60/967,337, filed on Sep. 4, 2007.

(51) Int. Cl.
*H01R 25/00* (2006.01)

(52) U.S. Cl. ..... 439/652

(58) Field of Classification Search ..... 439/652, 439/654, 535, 369, 501; 174/135, 53, 214, 174/117; 248/74.2, 74.3
See application file for complete search history.

(56) References Cited

U.S. PATENT DOCUMENTS

| | | | | |
|---|---|---|---|---|
| 1,935,771 | A | | 11/1933 | Feurstein et al. |
| D126,590 | S | | 4/1941 | Lewin |
| D164,338 | S | | 8/1951 | Tyler |
| D179,081 | S | | 10/1956 | Hudson |
| 3,290,453 | A | | 12/1966 | Jensen |
| 3,383,639 | A | | 5/1968 | Anderson et al. |
| 3,520,988 | A | | 7/1970 | Ballock, Sr. |
| 3,609,638 | A | | 9/1971 | Darrey |
| 3,781,761 | A | | 12/1973 | Harwood |
| 3,922,055 | A | | 11/1975 | McGregor |
| 3,924,914 | A | | 12/1975 | Banner |
| 4,083,621 | A | | 4/1978 | Davidson et al. |
| 4,095,871 | A | | 6/1978 | Holte |
| 4,118,690 | A | | 10/1978 | Paynton |
| 4,123,012 | A | | 10/1978 | Hough |
| D251,293 | S | * | 3/1979 | Trueblood ..... D13/137.2 |
| 4,183,603 | A | | 1/1980 | Donarummo |
| 4,500,150 | A | | 2/1985 | Leibensperger et al. |
| 4,504,106 | A | | 3/1985 | Fechter |
| D285,552 | S | | 9/1986 | Schwartz |
| D285,788 | S | | 9/1986 | Rapp et al. |
| 4,609,171 | A | * | 9/1986 | Matsui ..... 248/74.3 |

(Continued)

FOREIGN PATENT DOCUMENTS

| | | |
|---|---|---|
| DE | 33 43 233 | 6/1985 |

OTHER PUBLICATIONS

U.S. Appl. No. 12/649,465, filed Dec. 30, 2009, Lee.

(Continued)

*Primary Examiner*—Alexander Gilman
(74) *Attorney, Agent, or Firm*—Frost Brown Todd LLC

(57) ABSTRACT

An electrical, circuit breaker protected, extension cord in-line tap, securement device for securing tandemly connected electrical extension cords. The securement device includes opposing proximal and distal open-ended eyelets each having a hinged locking flap for receiving therein a looped end of the associated extension cord thereby preventing unintended separation of the extension cords. The in-line tap further includes a pair of circuit breaker protected auxiliary electrical outlets on opposing sides for powering additional extension cords.

12 Claims, 21 Drawing Sheets

U.S. PATENT DOCUMENTS 4,610,494 A 9/1986 Schauber
4,659,161 A 4/1987 Holcomb
4,669,688 A * 6/1987 Itoh et al. ..... 248/74.2
4,671,597 A 6/1987 Grill
D294,487 S 3/1988 Bannigan
4,764,128 A 8/1988 Cheng
4,778,125 A 10/1988 Hu
4,802,055 A * 1/1989 Beckerman ..... 361/56
D301,576 S 6/1989 Wang
D315,141 S 3/1991 Hames
5,004,435 A 4/1991 Jammet
5,071,367 A 12/1991 Luu
D325,723 S 4/1992 Gary et al.
D327,873 S 7/1992 Luu
5,207,594 A 5/1993 Olson
5,255,866 A 10/1993 Campolo
5,336,106 A 8/1994 Osten
D350,940 S 9/1994 Rossman et al.
D357,460 S 4/1995 Lovett
5,423,693 A 6/1995 Light
5,443,400 A 8/1995 Brown et al.
5,514,004 A 5/1996 Swanson
D372,702 S 8/1996 Sanner
5,562,488 A 10/1996 Neiser et al.
5,582,524 A 12/1996 Sanner et al.
D389,459 S 1/1998 Byrne
D397,086 S 8/1998 Lin
5,795,168 A 8/1998 Duhe
D400,175 S 10/1998 Okamoto
5,888,105 A 3/1999 Brown et al.
D408,355 S 4/1999 Welsh et al.
D409,146 S 5/1999 Fladung
5,931,702 A 8/1999 Fladung
D415,105 S 10/1999 Lee
6,004,157 A 12/1999 Glass
D425,638 S 5/2000 Yuen
6,056,580 A 5/2000 Cross et al.
D436,345 S 1/2001 Lentine
6,179,665 B1 1/2001 Rossman et al.
D440,203 S 4/2001 Ewing et al.
6,666,712 B1 * 12/2003 Kramer ..... 439/501
D486,126 S 2/2004 Aromin
D487,726 S 3/2004 Okuda
D493,426 S 7/2004 Strayer
6,929,514 B1 * 8/2005 Chuang ..... 439/652
D540,257 S 4/2007 Ivanova et al.
D549,650 S 8/2007 Russell et al.
D559,184 S 1/2008 Russell et al.
D562,240 S 2/2008 Lee
7,371,121 B1 5/2008 Lee
D577,679 S 9/2008 Lee
7,442,090 B2 * 10/2008 Mori et al. ..... 439/652
D599,290 S 9/2009 Lee

OTHER PUBLICATIONS

U.S. Appl. No. 29/313,368, filed Dec. 30, 2008, Lee.

* cited by examiner

EXTENSION CORD LOCK AND IN LINE TAP

RELATED APPLICATIONS

This application claims the priority of U.S. Provisional Patent Application Ser. No. 60/967,337 filed on Sep. 4, 2007 and U.S. Design patent application Ser. No. 29/288,336 filed on Jun. 7, 2007.

FIELD OF THE INVENTION

The present invention generally relates to an electrical extension cord accessory. More particularly the present invention teaches an improved extension cord coupling device for tandemly connecting two separate extension cords together in a manner to prevent the extension cords from being uncoupled by application of an unintentionally applied tensile force.

BACKGROUND

Hand held electrically powered tools generally have a relatively short power cord that severely limits the range within which such tools may be used. It is generally the practice to employ an electrical extension cord to increase the distance from a power source to the power tool being used. However, the typical male/female connectors, when coupled together, often, unintentionally, pull apart thereby interrupting the electrical power supply to the tool in use. Often the tool user will tie the two cords together, in some manner, thereby preventing unintentional separation of the cord coupling. However, such a practice many times will place an undesired stress, and/or strain upon the cord in the knotted area.

Further, it is many times desired to attach an additional electrical accessory to the power supplying electrical extension cord such as a light, for night work, to illuminate the work area.

Thus there is a need for an easy to use extension cord coupling device that prevents the unintentional separation of a first extension cord from a second extension cord that does not place undue stress and/or strain upon the cord material and that also provides additional auxiliary receptacles for the receipt of additional extension cords.

PRIOR ART

Heretofore many devices have been proposed for connecting two electrical cords together in a manner to relieve undue stress and/or strain upon the extension cord material.

One such device is taught in U.S. Pat. No. 5,582,524 issued to Sanner et al., entitled "Cord Loc," on Dec. 10, 1996. Although the Sanner et al. device may relieve the stress and/or strain from two tandemly connected electrical extension cords it is relatively complex to use. The Sanner et al. device requires the user to first form a loop of the extension cord, pass the looped portion of the extension cord through an elongated eyelet and hook the looped portion of the extension cord upon a hook member.

A similar device is taught in U.S. Pat. No. 5,931,702 issued to Phil Fladung, entitled "Electrical Outlet In Line Tap," on Aug. 3, 1999. Although the Fladung device may also relieve the stress and/or strain from two tandemly connected electrical extension cords it is also relatively complex to use. The Fladung device also requires first forming a loop of the extension cord, inserting the looped portion of the extension cord through an elongated eyelet. A rotating post like assembly, hingedly attached to the top of the eyelet, must then be rotated downward through the looped portion of the extension cord that protrudes through the eyelet.

BRIEF SUMMARY OF THE PRESENT INVENTION

The present invention teaches a simplified and improved in-line tap coupling for tandemly connecting a pair of electrical extension cords that prevents unintentional separation of the male/female extension cord connectors.

The improved in-line tap coupling comprises a main body having an electrical input connector comprising a typical male type pin and spade connector means at the main body's proximal end for receiving the female connector of a first extension cord. A female connector means for receiving the male connector of a second extension cord is provided at its distal end. Extending laterally from the opposing sides of the main body are multiple female outlet connectors for receiving therein the male connectors of additional extension cords. A resetable circuit breaker is electrically placed between the input male connector and the female outlet connectors.

DETAILED DESCRIPTION OF THE PREFERRED EMBODIMENT

Figure 1:
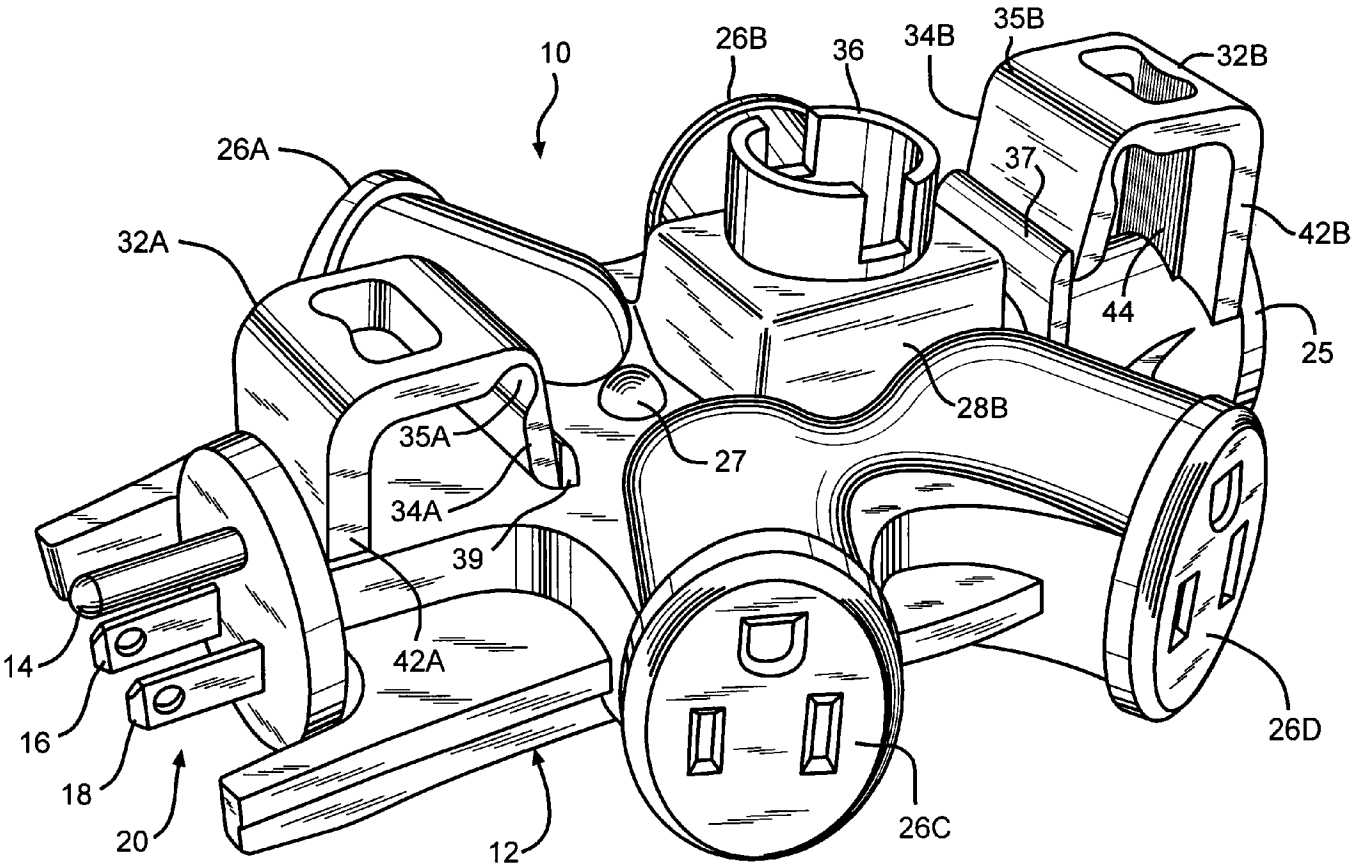
FIG. 1 presents a perspective view of an in-line tap embodying the present invention.
Figure 2:
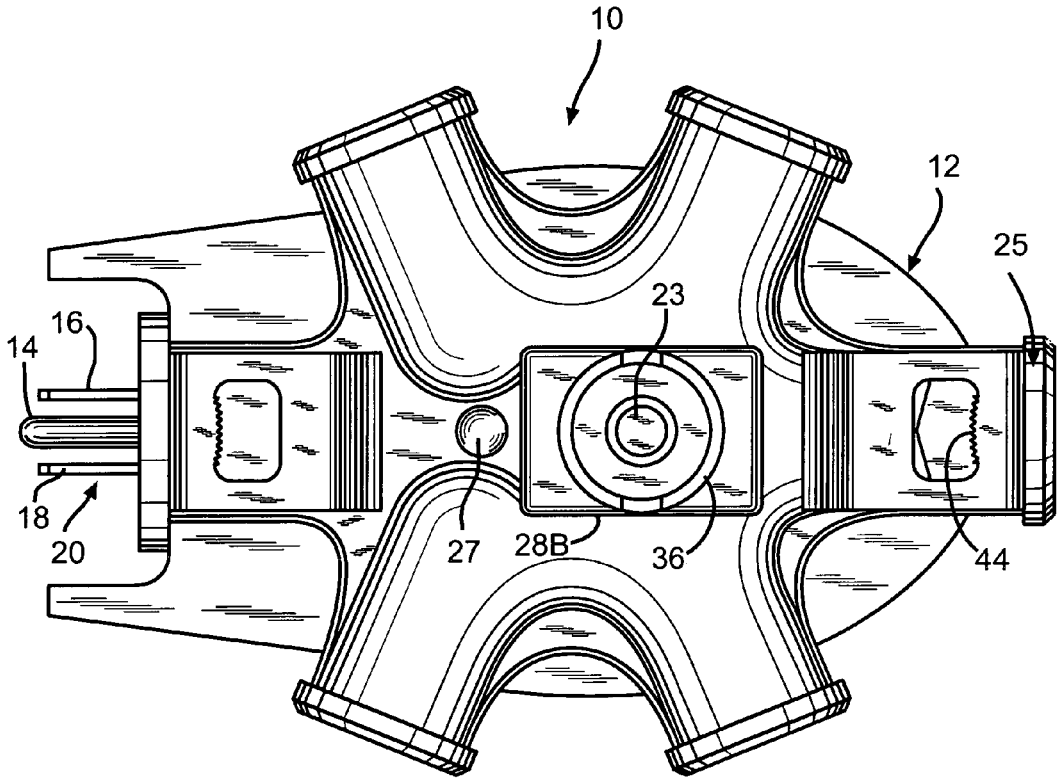
FIG. 2 presents a top plan view of the in-line tap illustrated in FIG. 1.
Figure 3:
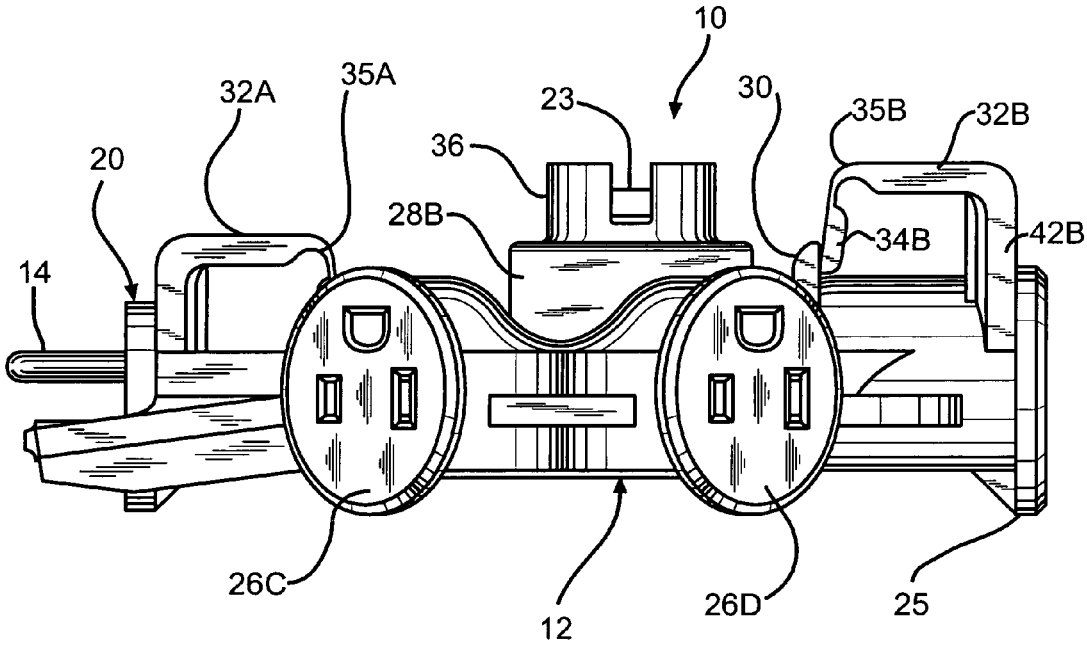
FIG. 3 presents a left side elevational view of the in-line tap shown in FIG. 1.
Figure 4:
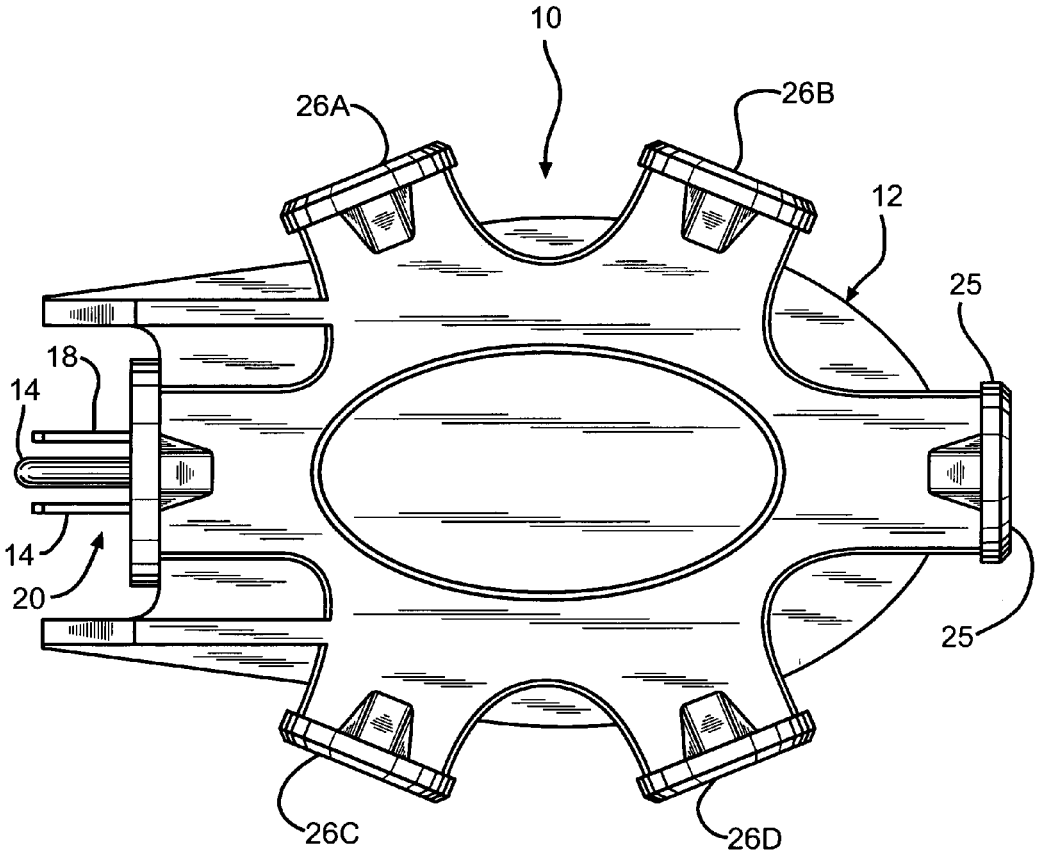
FIG. 4 presents a bottom view of the line-tap illustrated in FIG. 1.
Figure 5:
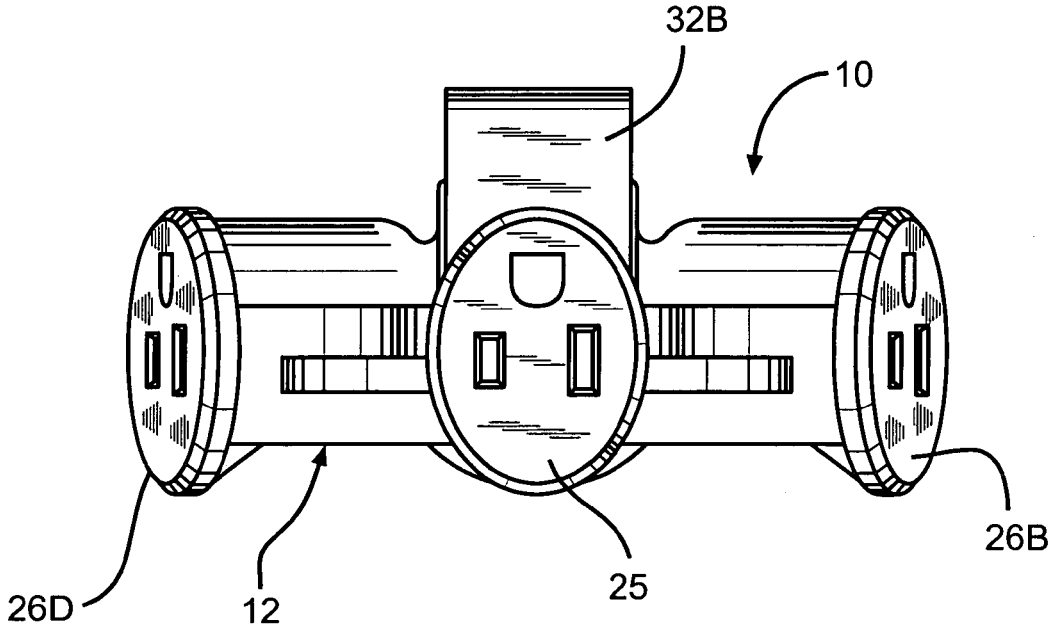
FIG. 5 presents a rear elevational view of the line-tap illustrated in FIG. 1.
Figure 6:
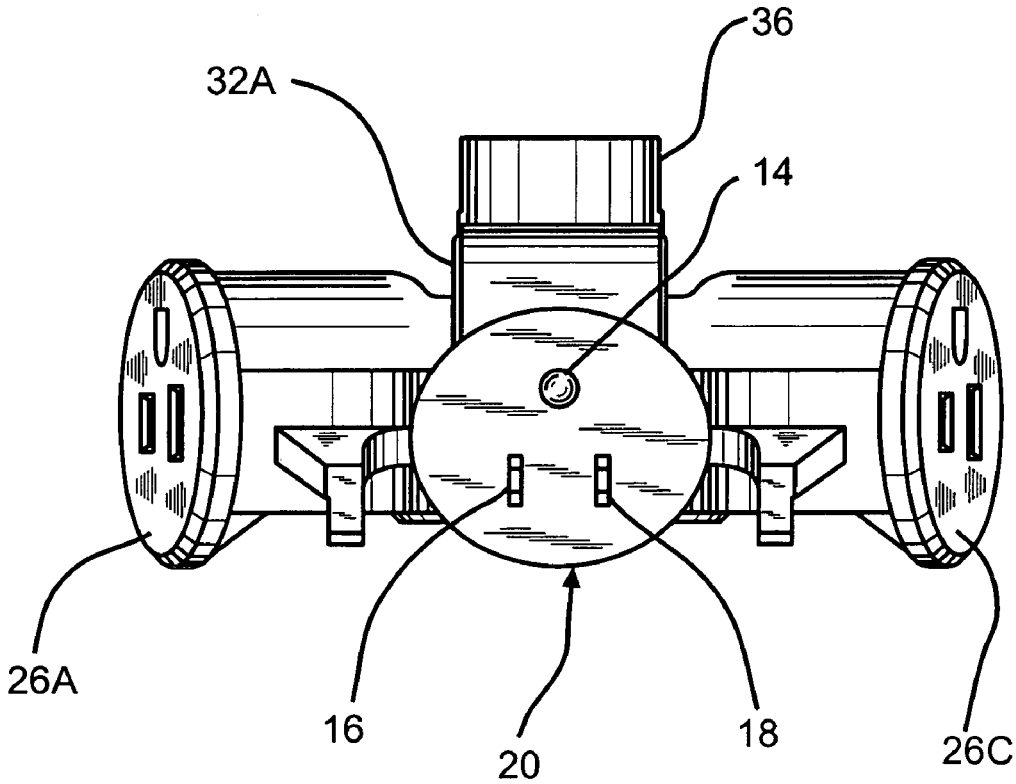
FIG. 6 presents a front elevational view of the line-tap illustrated in FIG. 1.
Figure 7:
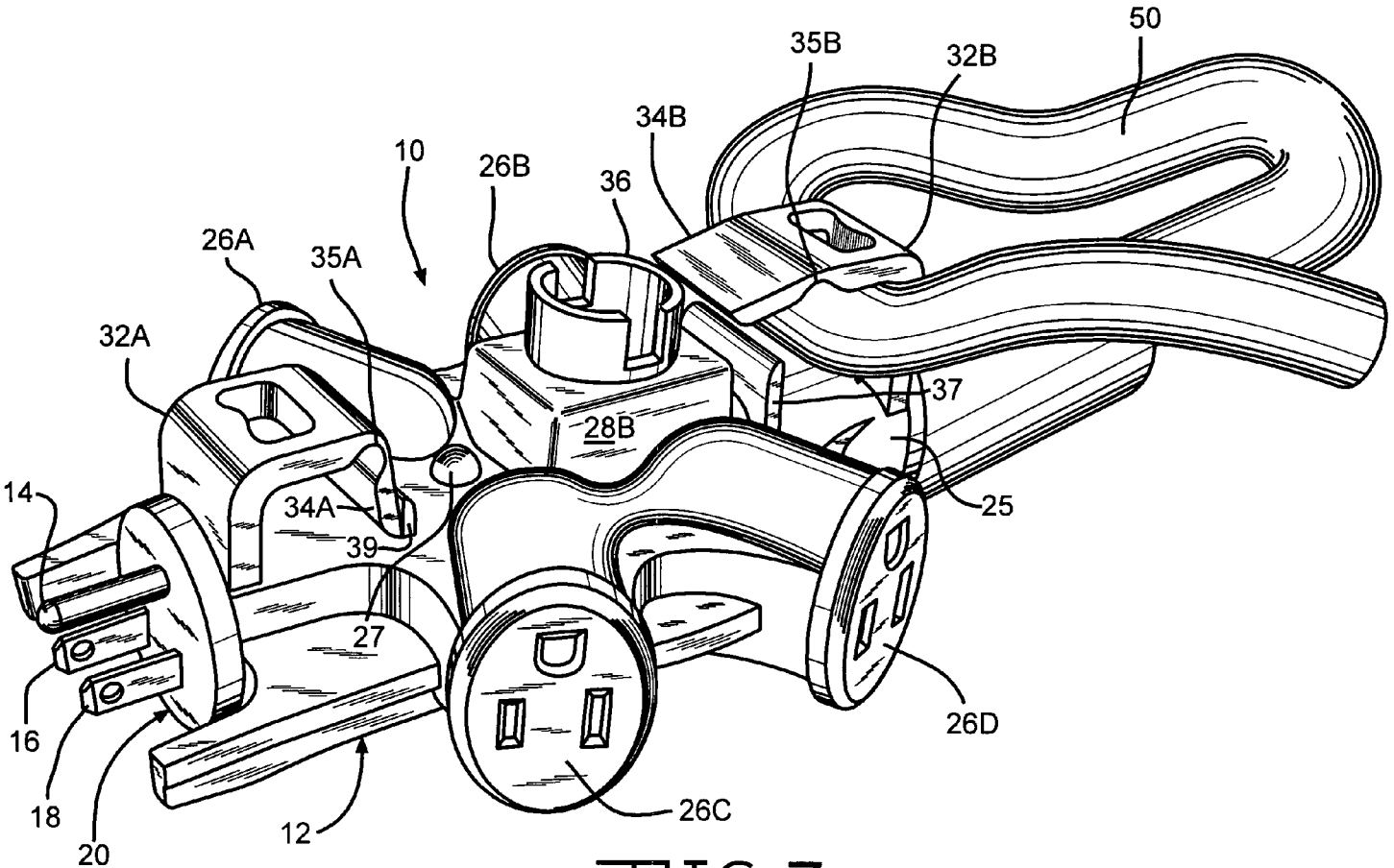
FIG. 7 through 9 presents a pictorial sequence of connecting two extension cords with the in-line tap illustrated in FIG. 1.
Figure 8:
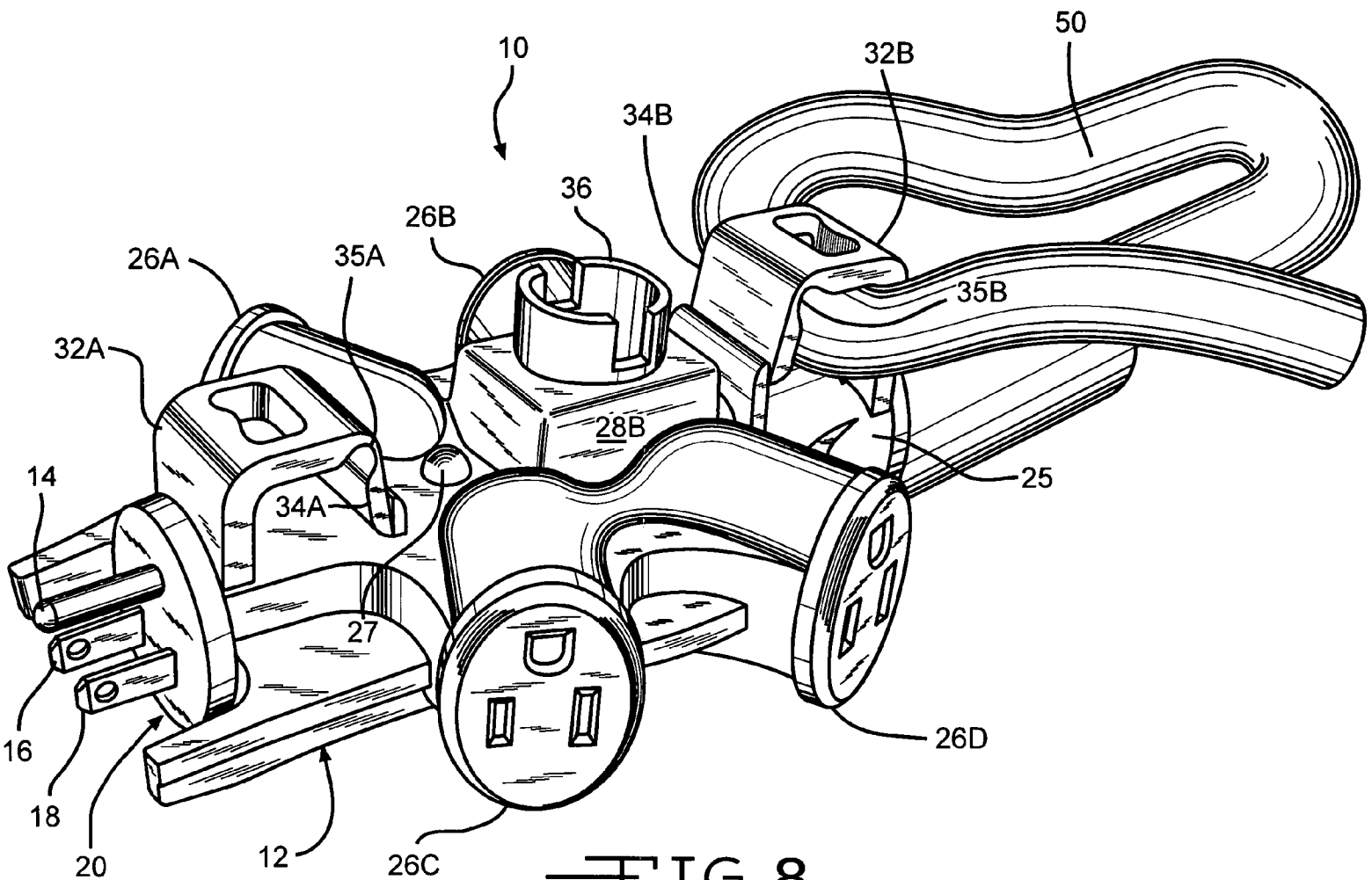
Figure 9:
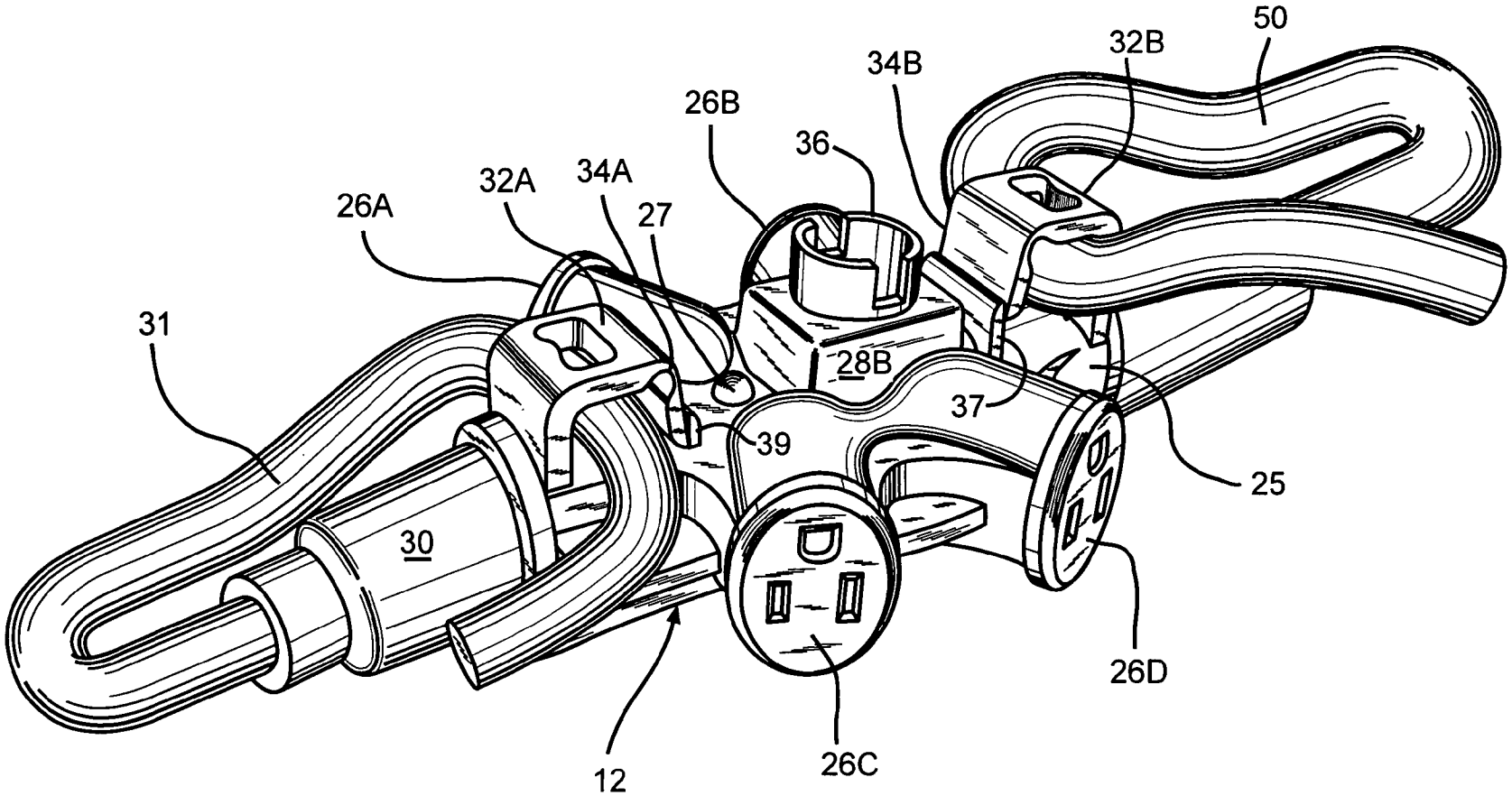

Referring to FIGS. 1 through 9, in-line tap 10 comprises a main body assembly 12 having a typical male electrical input connector 20, at its proximal end, typically comprising a grounding pin 14, a common electrical spade connector 16 and a live, or hot, electrical spade connector 18. A typical female electrical output connector 25 is provided at the distal end of main body 12 for receipt therein of the male electrical spade connectors of the add on electrical extension cord 50 as illustrated in FIGS. 7, 8 and 9.

Integral with main body assembly 12 are four auxiliary female electrical output connectors 26A, 26B, 26C, and 26D for connecting additional add-on electrical extension cords. An integrated and guarded circuit breaker 28B is provided to prevent an electrical overload on the electrical supply extension cord 31. A vertically extending guard 36 is preferably provided to protect the circuit breaker reset button 23. The internal structure of main body 12 and the electrical connections are further described below.

Integrally molded into the top of main body 12 are two angular hooks, or eyelets, 32A at its proximal end and 32B. at its distal end. Each eyelet includes a hinged closure flap 34A and 34B hinged to its associated eyelet by a "living hinge" 35A and 35B as best illustrated in FIG. 7. Hinge 34A and 34B are secured, when closed by upwardly protruding locking lip 39 and 37 respectively. Preferably the inside surface of back wall 42A and 42B is provided with vertical ribs 44 to grippingly secure the extension cord when locked within eyelets 32.

In Operation

Referring now to FIGS. 7, 8, and 9, hinged closure flap 34B is first opened, as illustrated in FIG. 7. The male electrical input connector prongs (not shown) of add-on extension cord 50 are inserted into the appropriate electrical output apertures of output connector 25 as illustrated in FIG. 7. Add-on extension cord is looped about back wall 42 of distal eyelet 32B, as illustrated in FIG. 7, and closure flap 34B is then snapped shut, as illustrated in FIG. 8 thereby securing add-on extension cord 50 therein.

With add-on extension cord 50 locked in place the male electrical input connector prongs 14, 16, and 18 of main body 12 are plugged into the female end 30 of electrical supply extension cord 31 as illustrated in FIG. 9. Electrical supply extension cord 31 is then similarly secured to the proximal eyelet 32A. Extension cords 31 and 45 are now secured one to the other so as not to pull apart.

Electrical Sub Assembly Structure

FIGS. 10 through 15 illustrate details of the internal, electrical subassembly 50 of the in-line tap illustrated and described in FIGS. 1 through 9 above.

Figure 10:
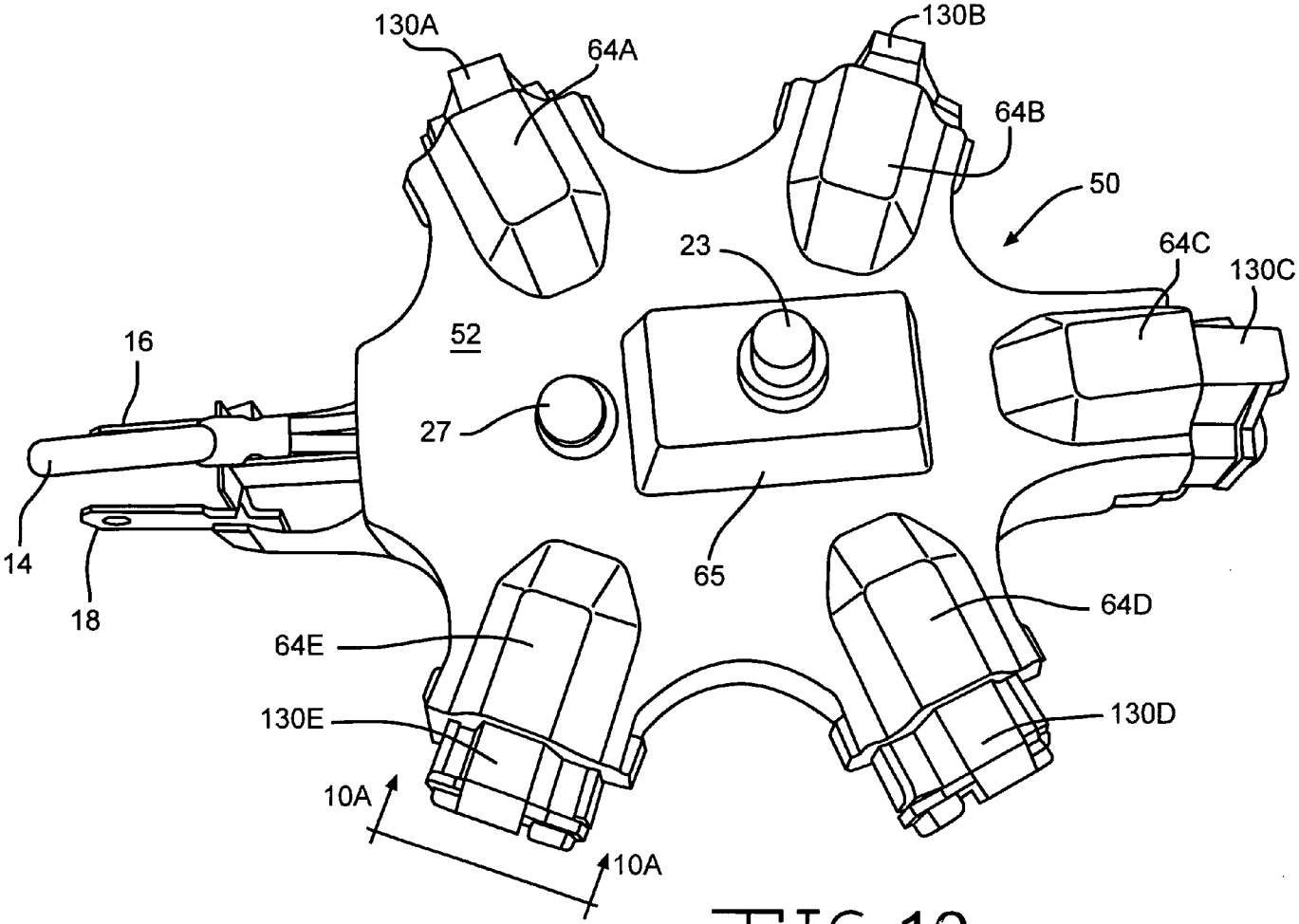
FIG. 10 presents a top pictorial view of the electrical subassembly encapsulated within the in-line-tap illustrated in FIG. 1.

FIG. 10 shows a top view of subassembly 50. Subassembly 50 once completed is fully encapsulated by an elastomeric covering thereby producing the final in-line tap configuration as illustrated in FIGS. 1 through 9.

Figure 11:
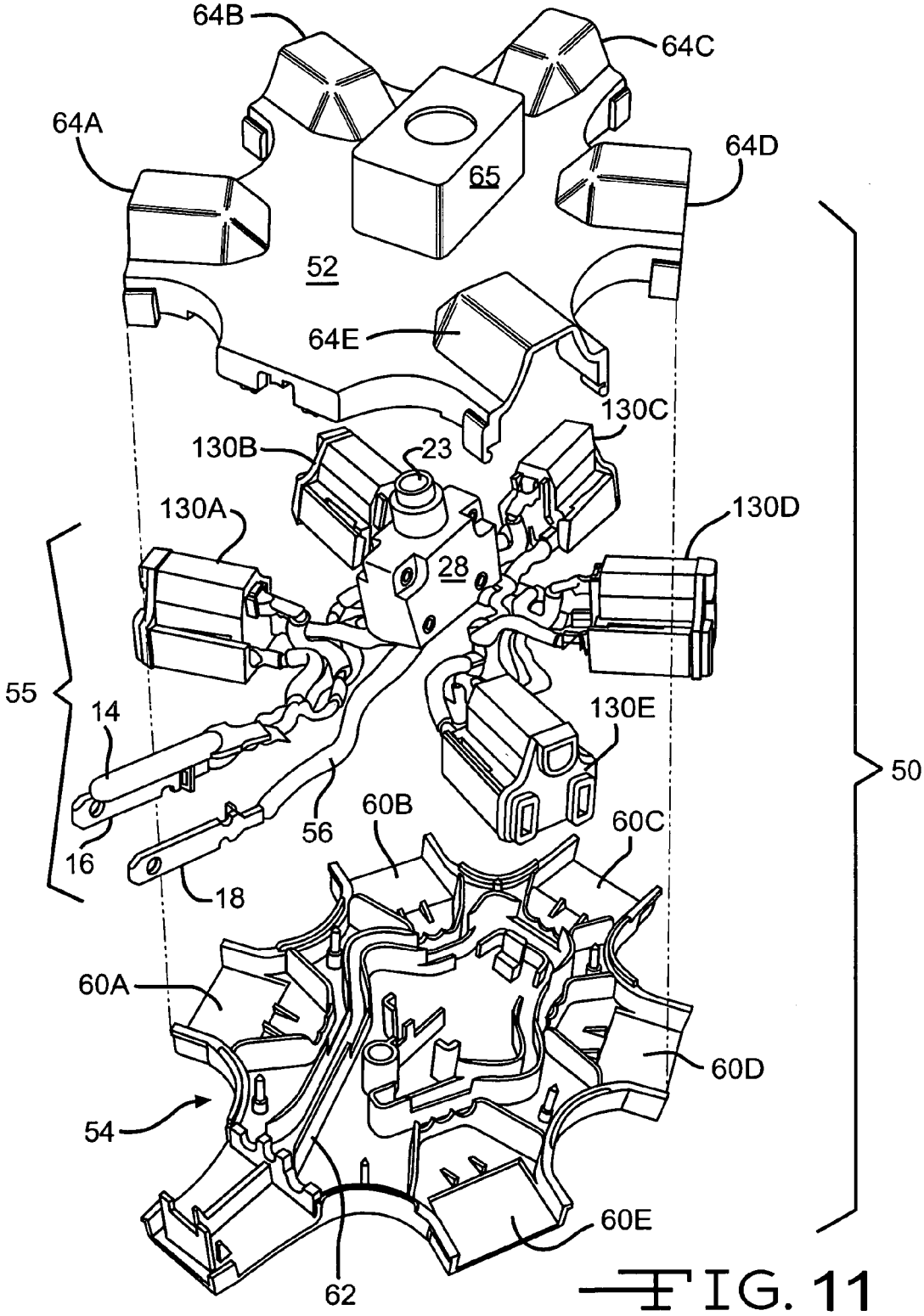
FIG. 11 presents an exploded pictorial view of the electrical subassembly illustrated in FIG. 10.
Figure 12:
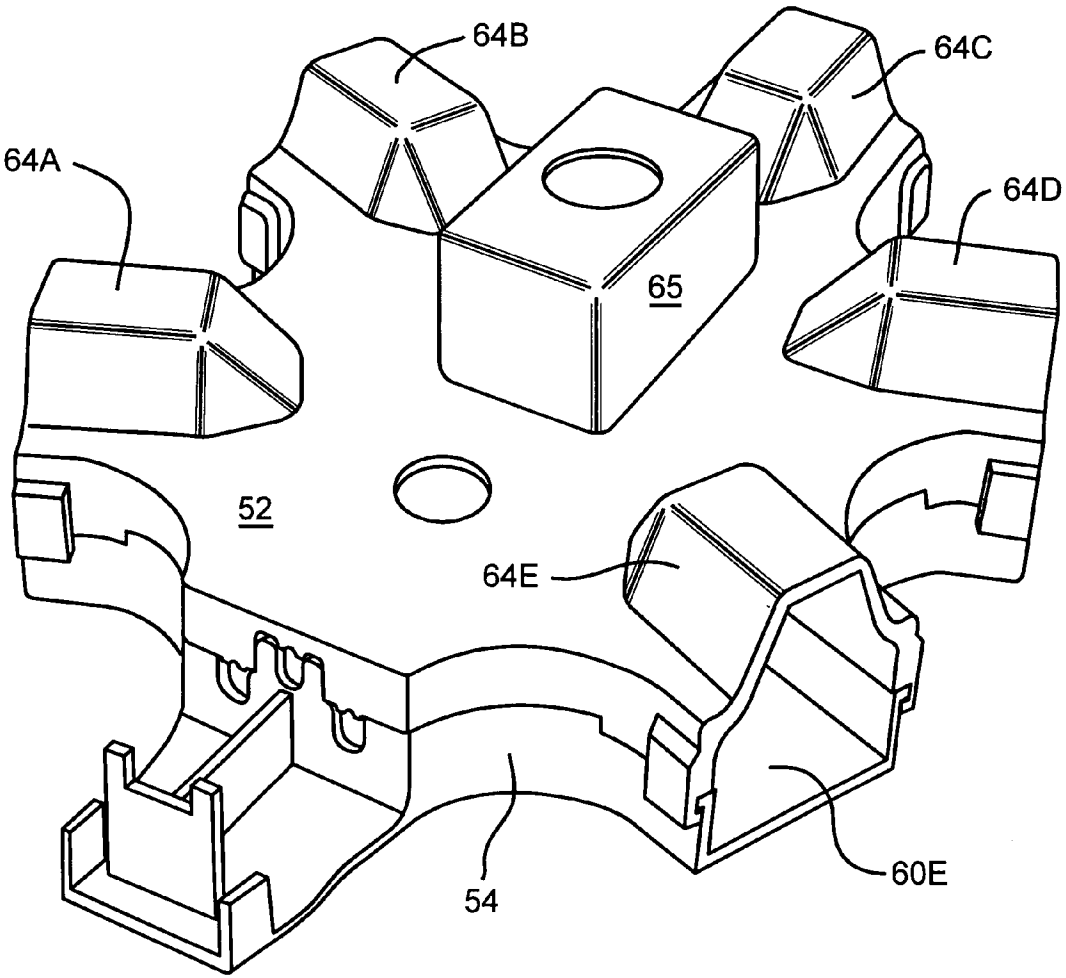
FIG. 12 presents a pictorial view of the electrical subassembly top and bottom shells assembled without the terminal connector assemblies.
Figure 13:
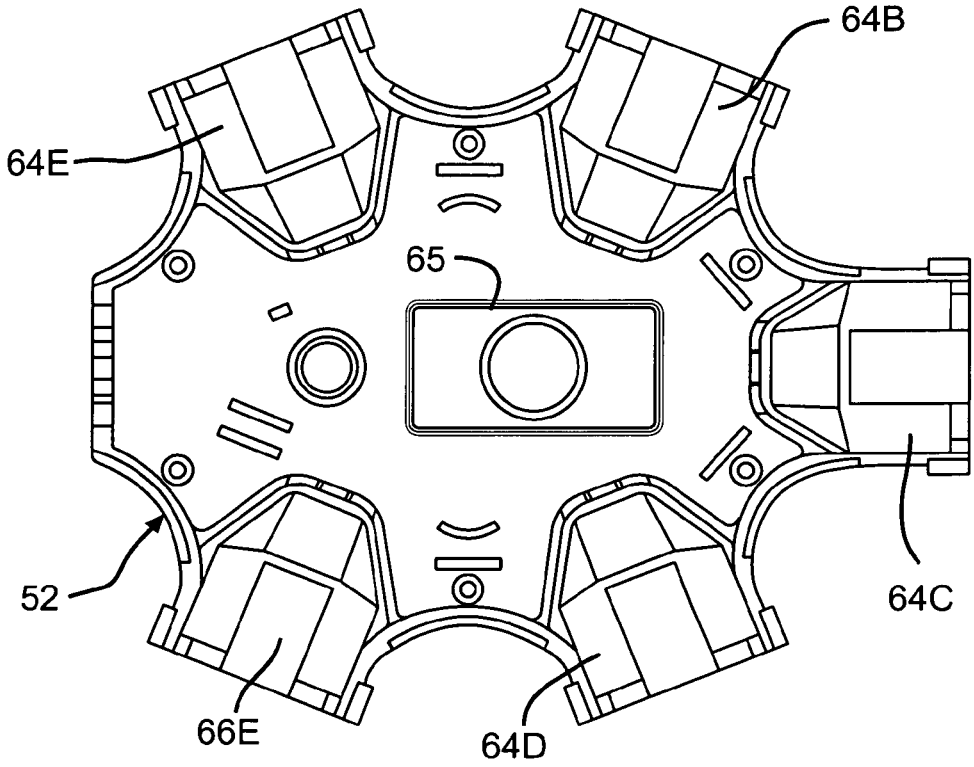
FIG. 13 presents an inside view of the top half shell of the electrical subassembly illustrated in FIG. 12.

Referring to FIG. 11, subassembly 50 generally comprises a top shell 52 and a bottom shell 54. Spaced between top shell 52 and bottom shell 54 is the electric power distribution circuitry 55.

Figure 15:
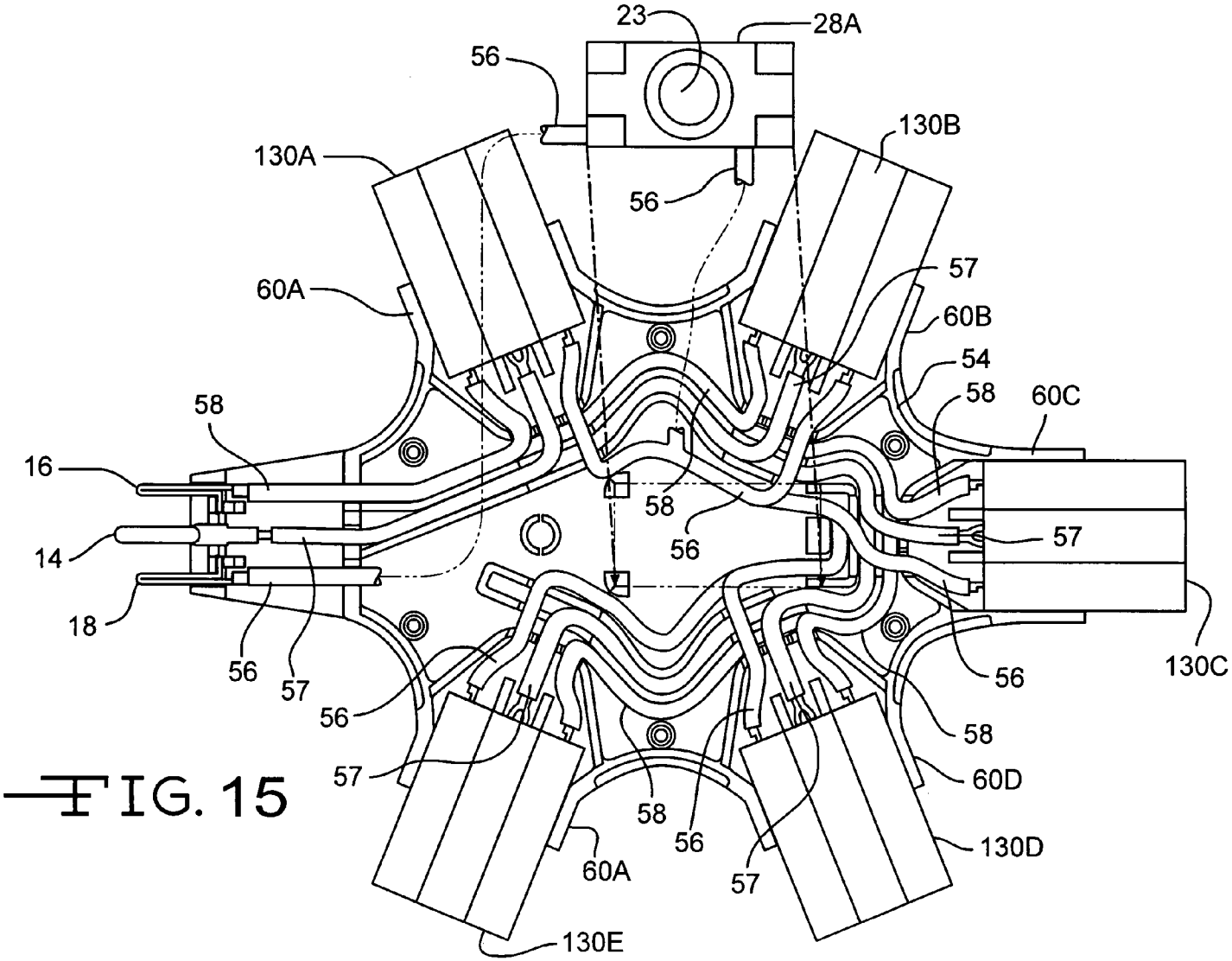
FIG. 15 presents a wiring diagram for the electrical connector assembly, positioned within the bottom half shell of the electrical subassembly and the separate electrical connector assemblies illustrated in FIG. 10.

Referring to FIGS. 11 and 15, electric power distribution circuitry 55 comprises an active, or hot, busbar wire 56 attached to active spade connector 18, a common busbar wire 58 attached to common spade connector 16 and a grounding wire 57 attached to grounding pin 14.

Terminal connector assemblies 130 A, 130B, 130C, 130D, and 130E, having their appropriate terminals connected to the active, common and ground wires, are positioned within molded saddles 60A, 60B, 60C, 60D, and 60E respectively as illustrated in FIG. 15.

Figure 14:
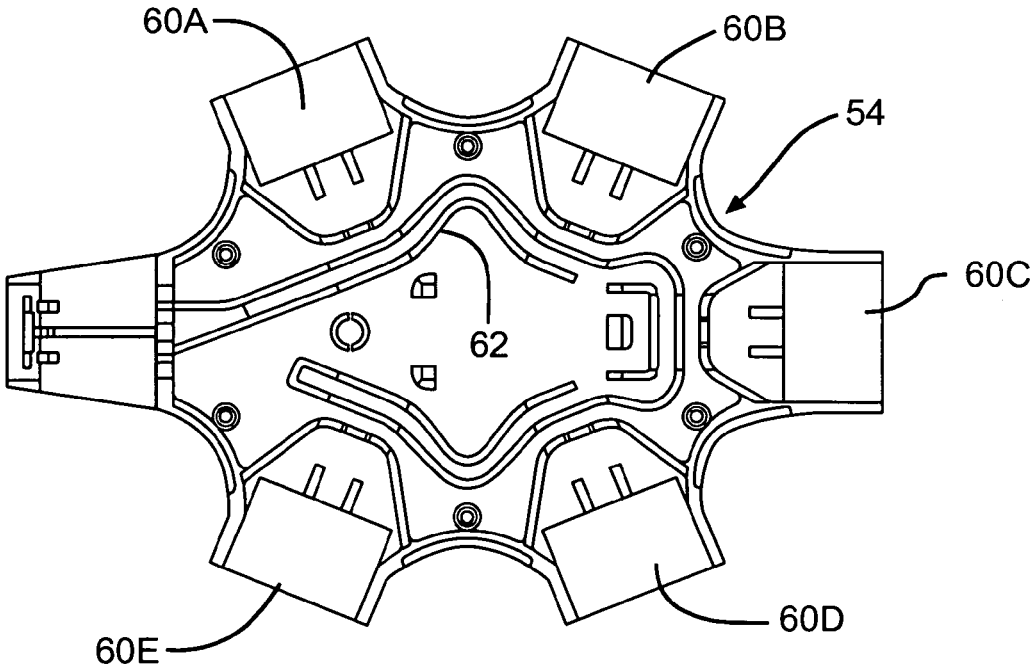
FIG. 14 presents an inside view of the bottom half shell of the electrical subassembly illustrated in FIG. 12.

As illustrated in FIGS. 11 and 14, bottom shell 54 is further provided with integrally molded wiring guide channel 62 for ground busbar wire 57 therein.

Figure 15A:
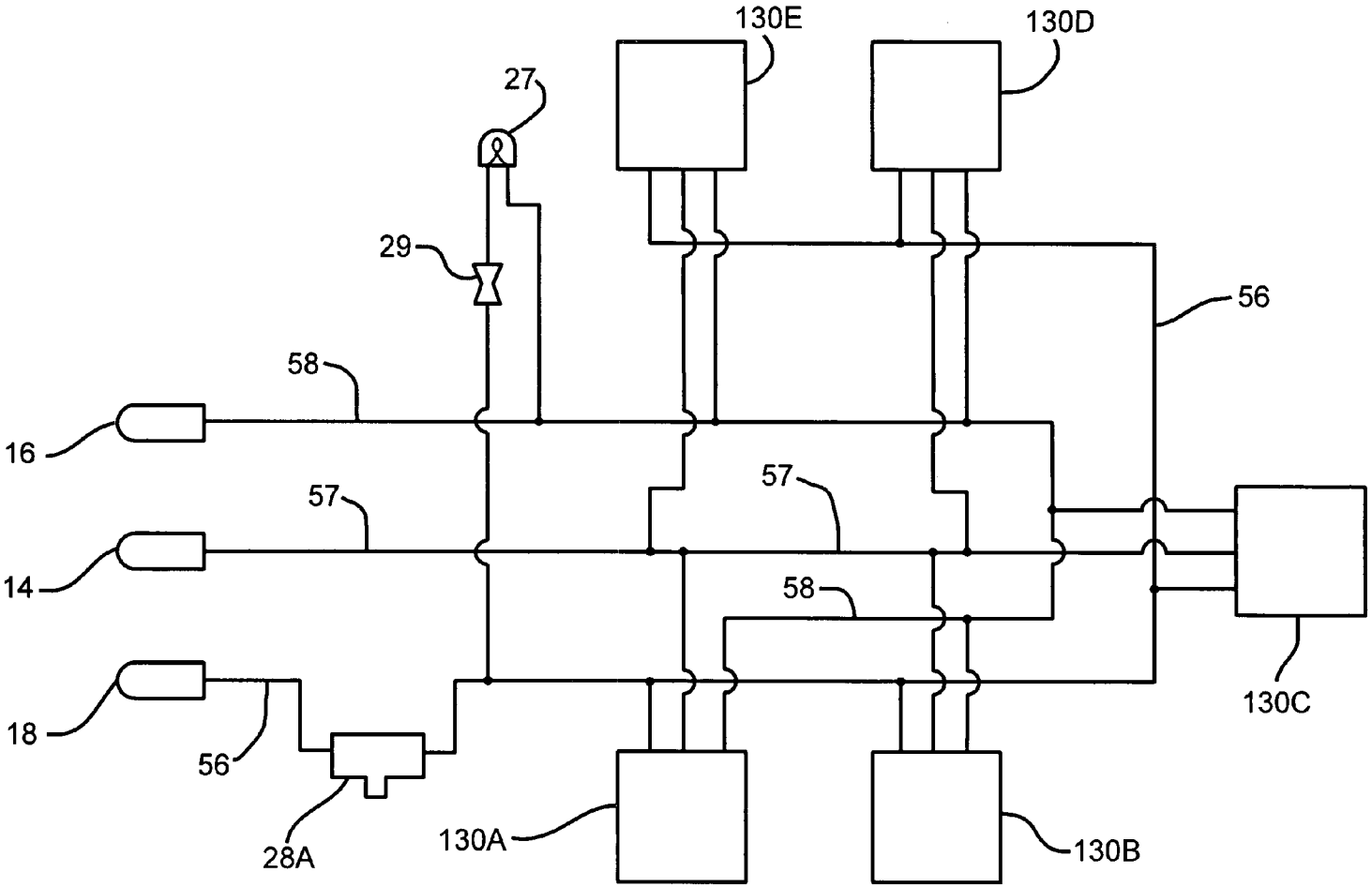
FIG. 15A presents an electrical schematic of the electrical subassembly illustrated in FIG. 10.
Figure 16:
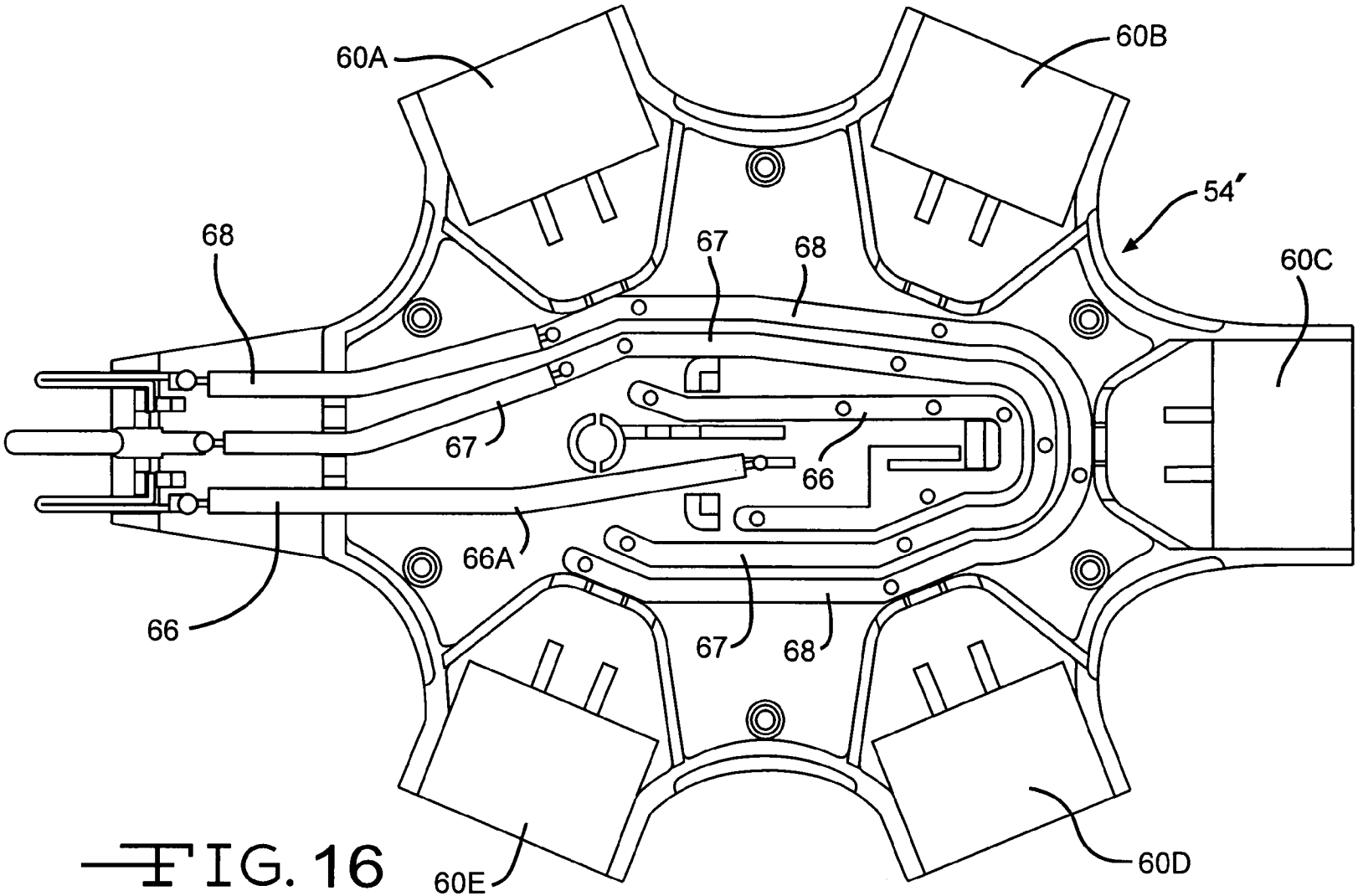
FIG. 16 presents an alternate embodiment of the bottom half shell of the electrical subassembly illustrated in FIG. 10 wherein stamped metal, electrical busbars replace the distribution wiring illustrated in FIG. 15.
Figure 17:
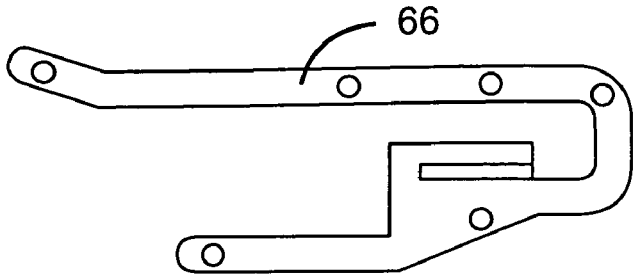
FIGS. 17-19 presents the configuration of the stamped metal, electrical busbars of FIG. 16.
Figure 18:
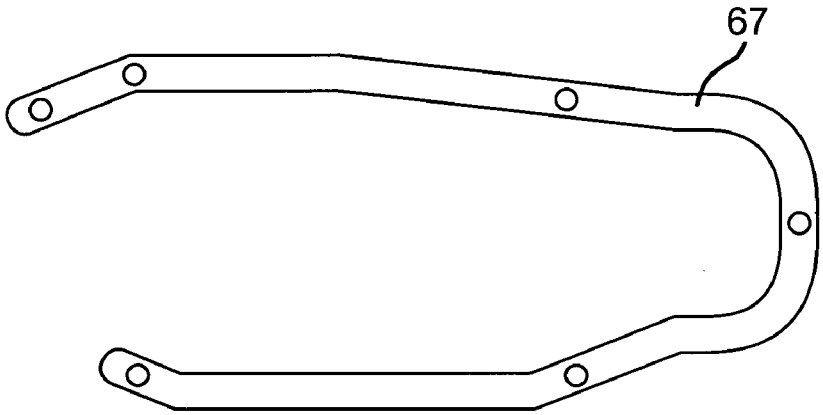
Figure 19:
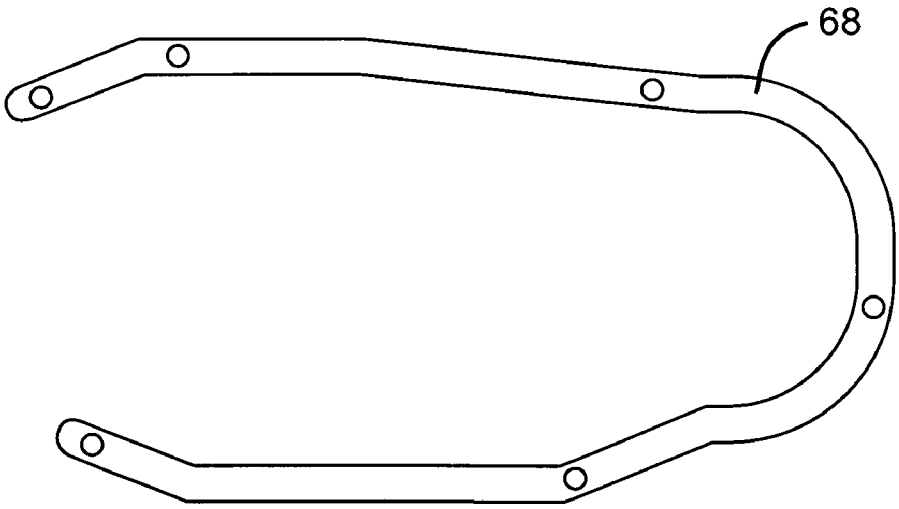

Busbar wires 56, 57, and 58 are preferably made of braided copper strands thereby producing a flexible electrical conducting wire. Ground busbar wire 14 is preferably placed within channel 62 generally circumscribing shell 54 as best illustrated in FIG. 15. common busbar wire 58 is wrapped about the outside periphery of channel 62 and active busbar wire 56 is wrapped about the inside periphery of channel 62 each being held in place by appropriately positioned guide lugs. Connecting wires from the appropriate terminals of each connector assembly 130 are attached to each appropriate busbar wire 56, 57, or 58. In this way busbar wires 56, 57, and 58 need not have an insulator covering and may be installed as bare wires separated from one another by the walls of channel 62. However, it is preferred to insulate the wires from the connectors 130 to the busbar wires. FIG. 15A presents a circuit diagram of the subassembly wiring After having positioned circuit breaker 28A, terminal connector assemblies 130 and wiring 56, 57 and 58, within bottom shell 54, top shell 52 is placed atop the assembly thereby completing sub assembly 50. as illustrated in FIG. 10. Integrally molded dome covers 64A, 64B 64C 64D, and 64E and saddles 60A, 60B, 60C, 60D, and 60E closingly encase terminal connector assemblies 130A, 130B, 130C, 130D and 130E therebetween. Similarly dome 65 acts to encase circuit breaker 28A.

Figure 10A:
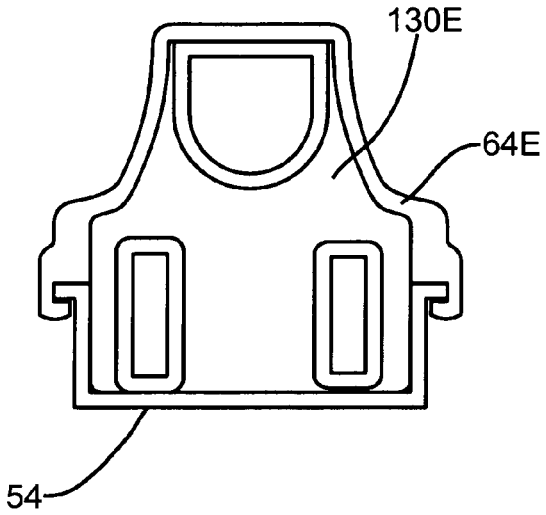
FIG. 10A presents an elevational view taken along line 10A-10A in FIG. 10.
Figure 21:
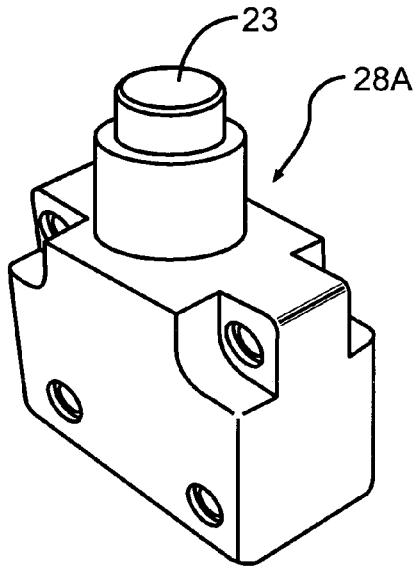
FIG. 21 presents an isolated pictorial view of the circuit breaker incorporated within the line-tap wiring.

The top shell 52 and bottom shell 54 are typically snapped together as illustrated in FIG. 10A. However, the two shells may be assembled using a suitable adhesive, electron beam welding or any other convenient means.

Figure 20:
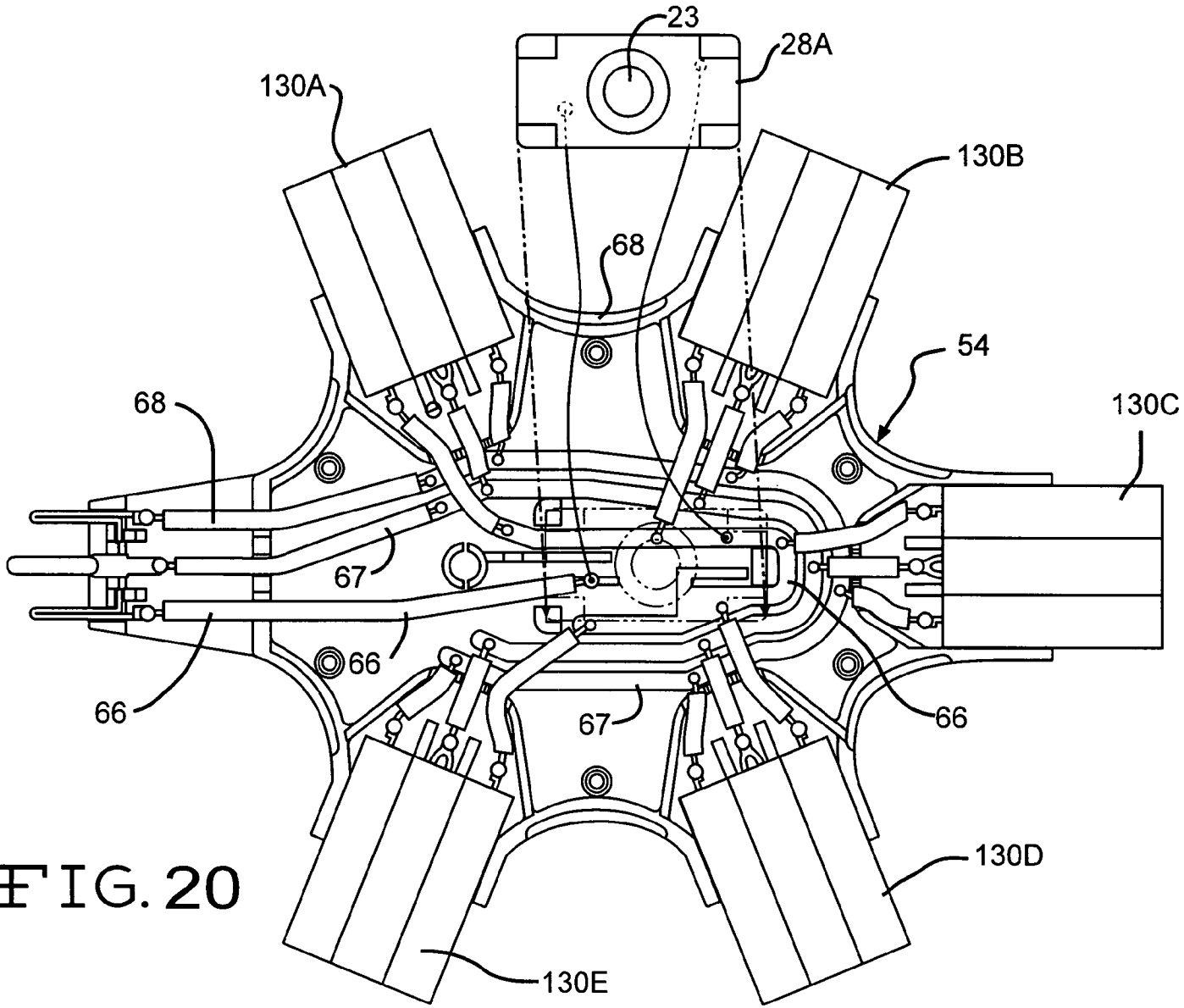
FIG. 20 presents a wiring diagram for the stamped metal, electrical busbars and the separate electrical connector assemblies positioned within the bottom half shell of the electrical subassembly illustrated in FIG. 10.

Turning now to FIGS. 16, 17, 18, 19, and 20, an alternate embodiment of the bottom shell assembly 54' is illustrated. Braided wire busbars 56, 57, and 58 may be replaced by flat fabricated brass or copper busbars 66, 67 and 68 respectively. The ground busbar is divided into two elements 66A and 66B with circuit breaker 28A interconnecting the two The appropriate connecting wires to each connector assembly are soldered to its appropriate busbar as illustrated in FIG. 20. All active connecting wires are soldered to element 66*b* thereby providing circuit breaker overload protection for all connector assemblies 130A, 130B, 130C, 130D, and 130E.

Once subassembly 50 is complete, it is encapsulated within a one piece molded, elastomeric covering as illustrated in FIGS. 1 through 6.

Figure 22:
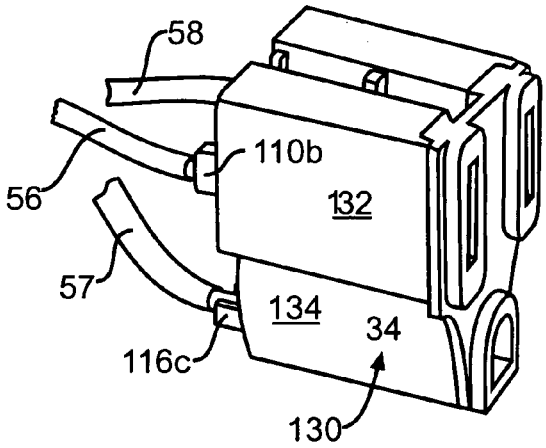
FIG. 22 presents an isolated pictorial view of one electrical outlet connector assembly.
Figure 23:
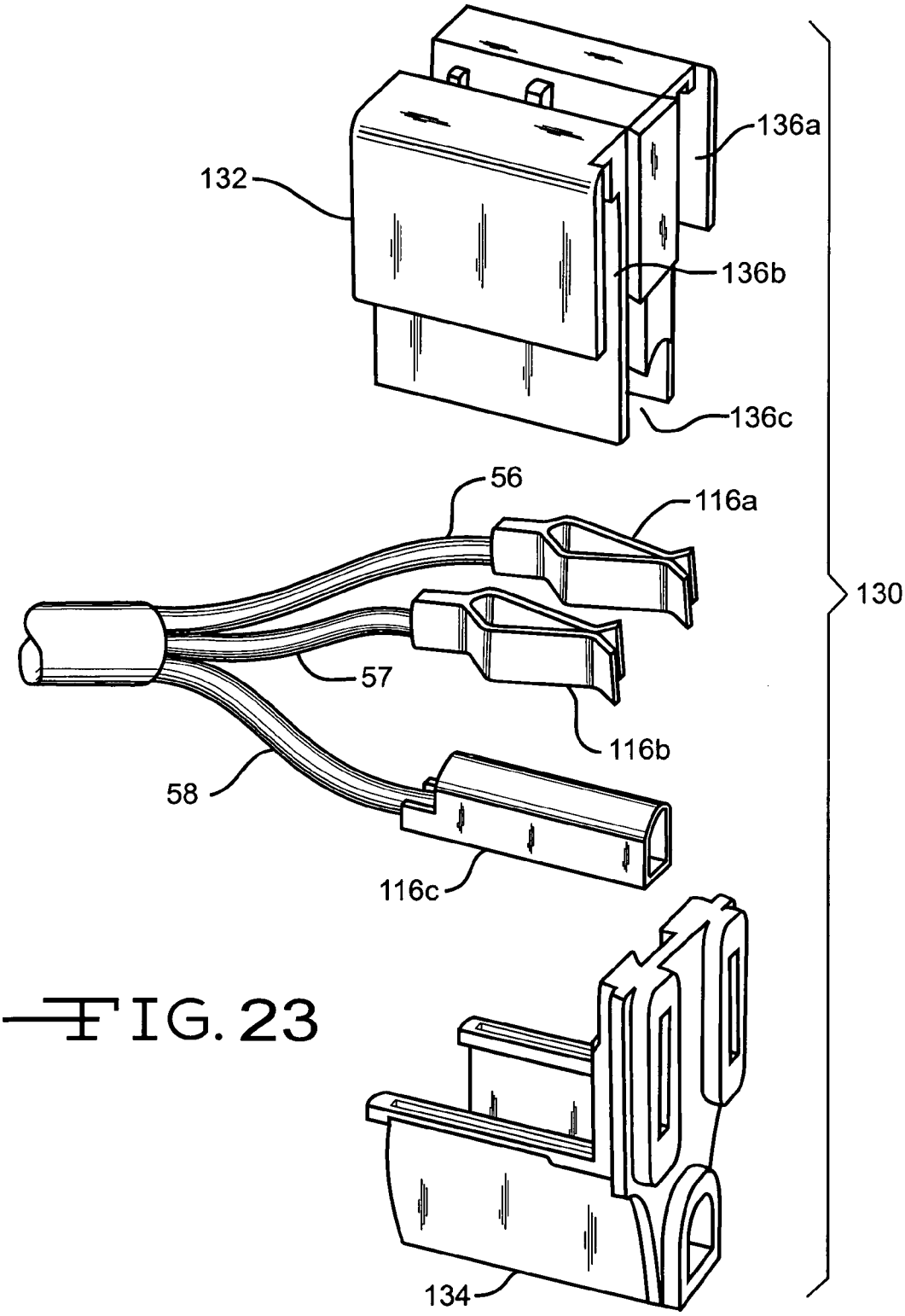
FIG. 23 presents an exploded pictorial of the component parts of one electrical outlet connector assembly as illustrated in FIG. 22.
Figure 24:
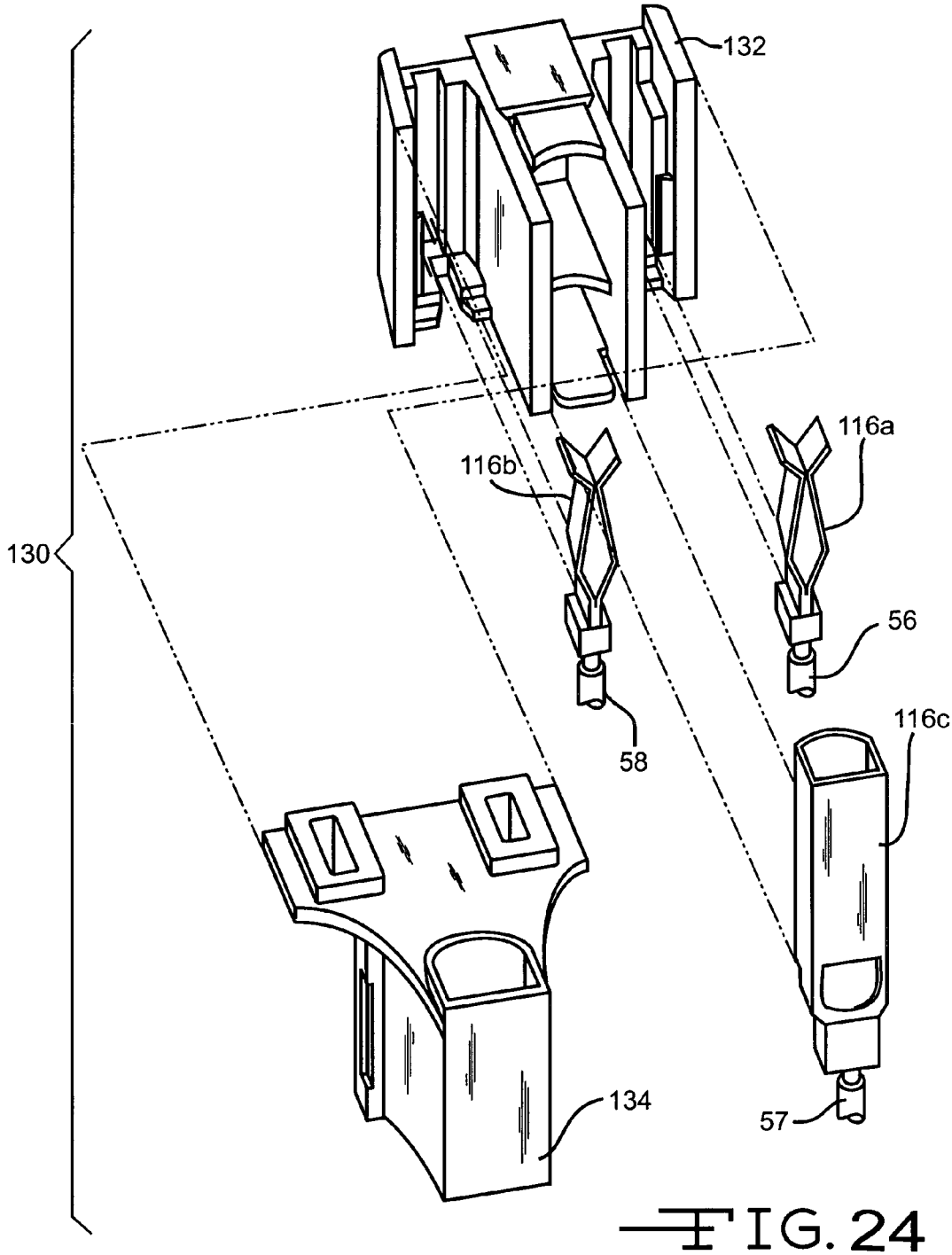
FIG. 24 presents an inverse exploded pictorial of the outlet connector assembly illustrated in FIG. 22.

Referring now to FIGS. 22 through 24 terminal connector assembly 130 basically comprises a unitary, molded upper component 132 and a unitary molded lower component 134. Upper component 132 includes two open ended cavities

136*a*, receiving therein spade electrodes 116*a*, and cavity 136*b*, receiving therein spade electrode 116*b*. Appropriately positioned between cavities 136*a* and 136*b* is open ended cavity 136*c* receiving therein pin electrode 116*c*.

Lower component 134, of assembly 130, completes the assembly by receiving therein upper component 132 having electrodes 116*a*, 116*b*, 116*c* Upper and lower components, 132 and 134, snap together and may be held together by a "snap together locking mechanism," by a suitable adhesive, electron beam welding or any other convenient means.

While I have described above the principles of my invention in connection with specific embodiments, it is to be clearly understood that this description is made only by way of example and not as a limitation of the scope of my invention as set forth in the accompanying claims.

I claim:

1. An electrical extension cord connecting device for electrically connecting a first and second extension cord in tandem arrangement whereby said extension cords may not be inadvertently separated comprising:

a) a main body member having a proximal end and an opposite distal end, b) said proximal end having male extension cord electrical connection members for connecting to the female electrical connection members of said first extension cord, and c) said distal end having female extension cord electrical connection members therein for connecting to the male electrical connection members of said second extension cord, d) said proximal end male electrical connection members, of said main body, electrically communicating with said distal end female electrical connection members, e) a first hook member atop said proximal end of said main body member having an open end thereof opening toward said distal end of said main body, whereby said first extension cord, when electrically connected to said male electrical connection members of said main body, may be passed through said first hook member, f) a hinged flap hingedly attached to said first hook member, extending from the top of said hook member, across the opening of said first hook member, to said main body, whereby the cord of said first extension cord maybe secured within said first hook member, g) a second hook member atop said distal end of said main body having an open end opening toward said proximal end of said main body, whereby said second extension cord, when electrically connected to said female electrical connection members of said main body, may be passed through said second hook member, h) a hinged flap hingedly attached to said second hook member, extending from the top of said second hook member, across the opening of said second hook member, to said main body, whereby the cord of said second extension cord maybe secured within said second hook member, and (i) an electrical circuit breaker interposed between said proximal end male electrical connection members and said distal end female electrical connection members, wherein said electrical circuit breaker comprises a circuit breaker reset button positioned between said first hook member and said second hook member, wherein said main body further comprises a vertically extending guard integrally molded into said main body and positioned around at least a portion of said circuit breaker reset button.

2. The electrical extension cord connecting device as claimed in claim 1 wherein at least one auxiliary set of female electrical connection members is interposed between said proximal end male electrical connection members of said main body and said distal end female extension cord electrical connection members.

3. The electrical extension cord connecting device as claimed in claim 2 wherein four auxiliary sets of female electrical connection members are interposed between said proximal end male electrical connection members and said distal end female electrical connection members.

4. The electrical extension cord connecting device as claimed in claim 1 wherein a neon lamp is interposed between said proximal end male electrical connection members and said distal end female electrical connection members whereby said lamp is lighted when said electrical extension cord connecting device is electrically powered.

5. The electrical extension cord connecting device as claimed in claim 1, wherein the main body member further comprises:

a) a first locking lip, wherein said first locking lip is positioned between said first hook member and said electrical circuit breaker, wherein said first locking lip is configured to releasably engage said hinged flap member hingedly attached to said first hook member when said hinged flap member is in a closed position; and b) a second locking lip, wherein said second locking lip is positioned between said second hook member and said electrical circuit breaker, wherein said second locking lip is configured to releasably engage said hinged flap member hingedly attached to said second hook member when said hinged flap member is in a closed position.

6. The electrical extension cord connecting device as claimed in claim 5, wherein said hinged flap member attached to said first hook member comprises an exterior surface, wherein said first locking lip comprises an interior surface, wherein said exterior surface of said hinged flap member attached to said first hook member abuts said interior surface of said first locking lip when said hinged flap member attached to said first hook member is in a closed position, and wherein said hinged flap member attached to said second hook member comprises an exterior surface, wherein said second locking lip comprises an interior surface, wherein said exterior surface of said hinged flap member attached to said second hook member abuts said interior surface of said second locking lip when said hinged flap member attached to said second hook member is in a closed position.

7. An electrical extension cord connecting device for electrically connecting a first and second extension cord in tandem arrangement comprising:

a) a main body member having a proximal end and an opposite distal end, b) said proximal end having male extension cord electrical connection members for connecting to the female electrical connection members of said first extension cord, and c) said distal end having a female electrical connector assembly for connecting to the male electrical connection members of said second extension cord, d) an electrical subassembly for electrically connecting said proximal end male electrical connection members to said distal end female electrical connector assembly comprising:

1) a top shell having at least one integrally molded dome cover, 2) a bottom shell comprising a perimeter, wherein said said bottom shell is configured to interlock with said top shell, wherein said bottom shell further comprises at least one molded saddle positioned along the perimeter, 3) at least one auxiliary female electrical connector assembly interposed between said proximal end male electrical connection members and said distal end female electrical connector assembly, wherein said at least one auxiliary female electrical connector assembly is aligned with said at least one molded saddle in the bottom shell and the dome cover in the shell, and 4) electrical connection means for electrically connecting said proximal end male electrical connection members to said distal end female electrical connector assembly, wherein said electrical connection means are positioned between said top shell and said bottom shell, e) said electrical subassembly encapsulated within a molded, unitary, elastomeric, outer body.

8. The electrical extension cord connecting device as claimed in claim 7 wherein said electrical subassembly includes four auxiliary female electrical connector assemblies interposed between said proximal end male electrical connection members and said distal end female electrical connector assembly.

9. The electrical extension cord connecting device as claimed in claim 8 wherein an electrical circuit breaker is interposed between said proximal end male electrical connection members and all of said female electrical connector assemblies.

10. The electrical extension cord connecting device as claimed in claim 7, wherein each one of said at least one auxiliary female electrical connector assembly comprises a terminal connector assembly, wherein each said terminal connector assembly is received within a corresponding one of the at least one molded saddle in the bottom shell.

11. An electrical extension cord connecting assembly comprising:

a) a first electrical extension cord comprising a female end attached to a cord body;

b) an electrical extension cord connecting device comprising (1) a main body member, wherein said main body member comprises (i) a proximal end, wherein said proximal end comprises male extension cord electrical connection members configured to engage said female end of said first electrical extension cord, and (ii) a distal end, wherein said distal end is opposite said proximal end, wherein said distal end comprises female extension cord connection members, wherein said female extension cord connection members are in electrical communication with said male extension cord connection members, (2) a first hook member, wherein said first hook member is configured to secure said first electrical extension cord, wherein said first hook member is positioned adjacent to said proximal end of said main body member, wherein said first hook member comprises (i) a back wall, wherein said back wall is integrally molded with and substantially fixed relative to said main body member, wherein said back wall extends substantially perpendicular to said main body member, wherein said back wall is configured to restrain proximal longitudinal movement of said cord body of said first electrical extension cord when at least a portion of said first electrical extension cord is positioned within said first hook member, (ii) an upper member, wherein said upper member is integral with said back wall at a first end, wherein said upper member comprises a free end opposite said first end, wherein said upper member extends substantially perpendicular to said back wall, and (iii) a closure flap, wherein said closure flap is hingedly attached to said free end of said upper member, wherein said closure flap is configured to transition between an open position and a closed position, wherein said closure flap is configured to restrain distal longitudinal movement of said cord body of said first electrical extension cord when at least a portion of said first electrical extension cord is positioned within said first hook member when said closure flap is in said closed position.

12. The electrical extension cord connecting assembly claimed in claim 11, wherein said assembly further comprises:

a) a second electrical extension cord, wherein said second electrical extension cord comprises a male end attached to a cord body; and b) wherein said electrical cord connecting device further comprises:

(1) a second hook member, wherein said second hook member is configured to secure said second electrical extension cord, wherein said second hook member is positioned adjacent to said distal end of said main body member, wherein said second hook member comprises (i) a second back wall, wherein said second back wall is integrally molded with and substantially fixed relative to said main body member, wherein said second back wall extends substantially perpendicular to said main body member, wherein said second back wall is configured to restrain distal longitudinal movement of said cord body of said second electrical extension cord when at least a portion of said second electrical extension cord is positioned within said second hook member, (ii) a second upper member, wherein said second upper member is integral with said second back wall at a first end, wherein said second upper member comprises a free end opposite said first end, wherein said second upper member extends substantially perpendicular to said second back wall, and (iii) a second closure flap, wherein said second closure flap is hingedly attached to said free end of said second upper member, wherein said closure flap is configured to transition between an open position and a closed position, wherein said second closure flap is configured to restrain proximal longitudinal movement of said cord body of said second electrical extension cord when at least a portion of said second electrical extension cord is positioned within said second hook member when said second closure flap is in said closed position.

* * * * *